United States Patent [19]

Allen, Jr.

[11] Patent Number: 4,602,430

[45] Date of Patent: Jul. 29, 1986

[54] NAIL CLIPPER HANDLE AND CLIPPING CATCHER

[76] Inventor: Alva Allen, Jr., 230 Cadiz La., College Park, Ga. 30349

[21] Appl. No.: 700,118

[22] Filed: Feb. 11, 1985

[51] Int. Cl.[4] ..... A45D 29/02

[52] U.S. Cl. ..... 30/28

[58] Field of Search ..... 30/28, 124

[56] References Cited

U.S. PATENT DOCUMENTS

| | | | |
|---|---|---|---|
| 2,515,852 | 7/1950 | Bilsky | 30/28 |
| 2,753,626 | 7/1956 | Bowers | 30/28 |
| 2,799,923 | 7/1957 | Senshu | 30/28 |
| 2,837,821 | 6/1958 | David | 30/124 |
| 2,887,773 | 5/1959 | Killen | 30/28 |
| 3,180,025 | 4/1965 | Tsunemi | 30/28 |
| 3,188,737 | 6/1965 | Chase | 30/124 |
| 3,855,698 | 12/1974 | Crosby | 30/28 |
| 3,943,948 | 3/1976 | Sartore | 30/28 |
| 4,341,015 | 7/1982 | Young | 30/28 |
| 4,380,120 | 4/1983 | Hannon | 30/28 |

*Primary Examiner*—Jimmy C. Peters

*Attorney, Agent, or Firm*—Jones & Askew

[57] ABSTRACT

A handle and clipping receptacle provides a removable accessory for a nail clipper of the lever action type. A resilient body member defines a slot into which the clipper can be inserted and retained by a depression formed in the bottom of the slot. The clipper is retained also by flanges and cavities within the body member. Large inner cavities extend within the body member on both sides of the clipper to receive and retain clippings sheared by the clipper. Such clippings can be disposed by removing the clipper and inverting the body member.

8 Claims, 6 Drawing Figures

NAIL CLIPPER HANDLE AND CLIPPING CATCHER

TECHNICAL FIELD

The present invention relates to an accessory for nail clippers of the lever action type, and more particularly relates to a handle and receptacle for retaining clippings.

BACKGROUND ART

Conventional lever action nail clippers are in widespread use for trimming fingernails and toenails. A well known disadvantage of such clippers is the tendency of clippings to fly away from the user when forecfully sheared off by the jaws of the clipper. Also, such clippers tend to be small and sometimes awkward to manipulate.

Attempts have been made in the past to provide receptacles for retaining clippings removed by lever action clippers. For example, U.S. Pat. No. 4,341,015 shows a clipper fixedly mounted within a tubular sleeve. U.S. Pat. No. 3,855,698 shows a clipper built into a block having a sliding cover which exposes side cavities for receiving clippings. U.S. Pat. No. 3,180,025 shows a clipper fixed to a hinged case that can be opened to empty clippings. U.S. Pat. No. 2,515,852 shows a clipper having removable side pockets which retain clippings. U.S. Pat. Nos. 2,753,626; 2,799,923; 2,829,433; 3,188,737; 3,744,131; 2,837,821 and 2,620,560 show other arrangements for catching nail clippings.

However, no prior device known to the applicant provides a handle which allows a conventional clipper to be inserted into a removed therefrom, as well as providing a receptacle for clippings.

SUMMARY OF THE INVENTION

The present invention provides an improved accessory for nail clippers of the lever action type, the clipper being selectively insertable into the accessory of the invention, which thus can be supplied apart from the clipper. The accessory provides a handle making the clipper easier to manipulate, and can advantageously provide an inner hollow cavity to receive clippings.

Generally described, the present invention provides a nail clipper handle for receiving a nail clipper of the type including a pair of elongated spring jaws fixed together at one end thereof and spaced apart at the opposite cutting end thereof, and a lever actuator attached to the upper end of a post extending through both the spring jaws adjacent to the cutting end thereof, the post including a head at the lower end of the post. The nail clipper handle comprises a body member formed of resilient material including a top exterior surface and a front exterior surface; the body member defining a slot therein open to the front exterior surface for removably receiving the clipper, an opening in the top surface through which extends the lever actuator, and means for resiliently retaining the clipper within the slot. The upper surface of the body member bears upon the clipper, and the retaining means cmprises a depression formed in the bottom of the slot for receiving the head of the post.

The body member preferably also defines at least one internal cavity extending laterally from the slot and communicating with the slot at a location at which the jaws are spaced apart. Such cavity collects the clippings propelled rearwardly by the action of the clipper jaws.

In the preferred form, such a cavity extends within the handle on both sides of the clipper from a point just behind the front surface of the body member backward along the length of the clipper.

The slot can be a channel open to the top surface of the body member, having flanges extending in over the rear portion of the clipper to retain the clipper in place, while leaving the cutting end of the clipper a small degree of freedom to move vertically to allow the head of the clipper post to snap into position in the depression formed in the bottom of the slot.

Thus, it is an object of the present invention to provide an improved handle for a lever action nail clippere.

It is further object of the invention to provide a handle for a nail clipper providing means for retaining clippings removed by the clipper.

It is a further object of the present invention to provide a handle into which a nail clipper can be inserted and from which the nail clipper can be removed as the operator desires.

It is a further object of the present invention to provide a clipping receptacle for a nail clipper, from which the clippings can easily be discarded.

Other objects, features, and advantages of the present invention will become apparent upon consideration of the following detailed description of a preferred embodiment thereof, when taken in conjunction with the appended drawing.

DETAILED DESCRIPTION

Figure 1:
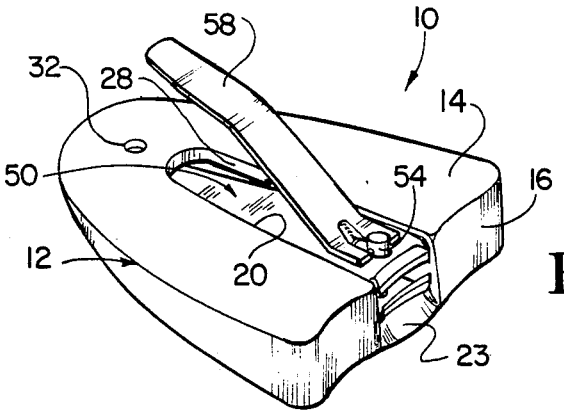
FIG. 1 is a perspective view of a handle and clipping receptacle embodying the present invention, showing a nail clipper inserted into the handle.

Referring now in more detail to the drawing, in which like numerals designate like parts throughout the several views, FIG. 1 shows a handle and clipping receptacle 10 embodying the present invention. The handle and clipping receptacle 10 is preferably formed as a single, shield-shaped body member 12 of a resilient material such as plastic. The body member 12 defines a top surface 14 and a front surface 16, which can have indentations on either side of the center thereof as shown in the drawing.

The body member 12 defines a slot or channel 20 opening to the front surface 16 and extending rearwardly. The slot 20 includes a flat bottom surface 22 which intersects an inclined surface 23 at a point spaced inwardly a short distance from the front surface 16. The inclined surface 23 slopes downwardly from the slot bottom 22 to the lower edge of the front surface 16. The slot bottom 22 includes a round depression 25 spaced inwardly from the inclined surface 23 to receive a part of the nail clipper in the manner described below.

Figure 2:
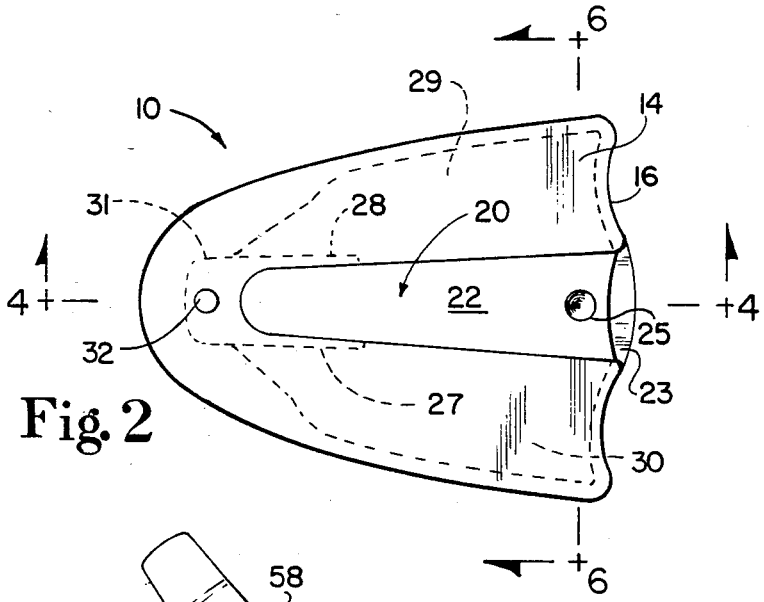
FIG. 2 is a top plan view of the handle of FIG. 1, without the clipper in place.
Figure 3:
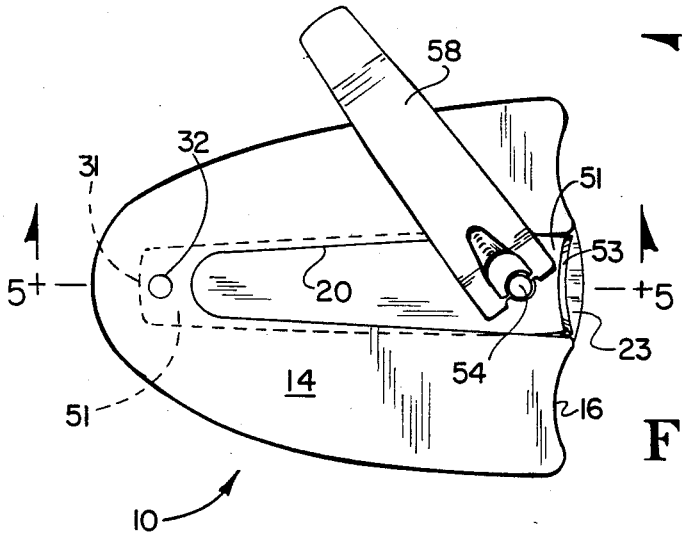
FIG. 3 is a top plan view of the handle of FIG. 1, with the nail clipper in place.
Figure 4:
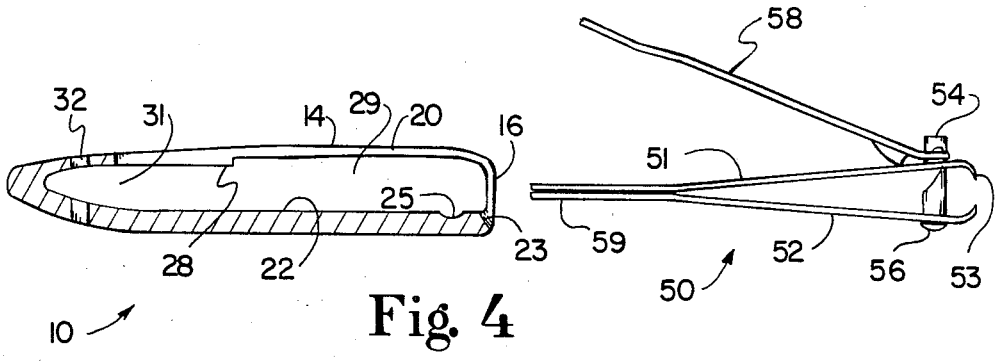
FIG. 4 is an exploded longitudinal cross-sectional view of the handle, taken along line 4—4 of FIG. 2, showing the clipper aligned for insertion into the handle.

The slot 20 intersects the top surface 14 in an elongated U-shaped opening as best shown in FIGS. 2 and 3. Near the rear end of the slot 20, a pair of flanges 27 and 28 extend downwardly, as shown in FIGS. 2 and 4. The slot 20 narrows at the location of the flanges 27 and 28. A pair of inner cavities 29 and 30 communicate with the slot 20 along the sides of the slot and extend laterally into the interior of the body member 12, as shown in dotted lines in FIG. 2. A rear cavity 31 is formed at the rear end of the slot 20 to matingly receive the rear end of a nail clipper, as will be described below. The body member 12 is run through vertically by a bore 32 which intersects the rear cavity 31.

The handle and clipping receptacle 10 is constructed to removably receive a conventional lever action nail clipper 50 of the type shown in FIGS. 1 and 4. The clipper 50 includes a pair of elongated spring jaws 51 and 52 fixed together at a rear end and spaced apart at a cutting end 53 where the jaws form curved cutting edges in a well known manner. A post 54 passes through the jaws 51 and 52. The post 54 includes a rounded head 56 on the lower end of the post below the lower jaw 52. The upper end of the post pivotally engages a lever actuator 58, operation of which closes the jaws together, shearing off a nail placed between the jaws. The spring tension of the jaws holds the head 56 firmly against the lower jaw 52. Near the rear end of the clipper 50, an opening 59 passes through the jaws, as shown in FIG. 5, the opening being formed typically by a rivet holding the jaws together.

Figure 5:
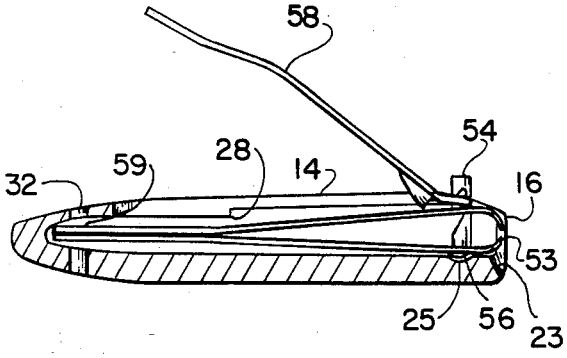
FIG. 5 is a longitudinal cross-sectional view of the handle and clipper taken along line 5—5 of FIG. 3.
Figure 6:
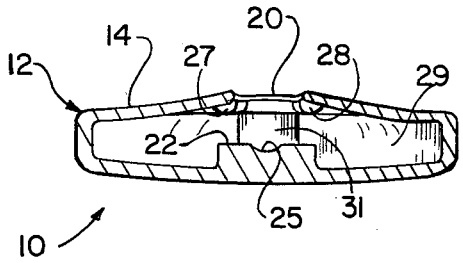
FIG. 6 is a lateral cross-sectional view of the handle taken along line 6—6 of FIG. 2.

In order to utilize the handle and clipping receptacle 10 of the present invention, the clipper 50 is moved from a position as shown in FIG. 4 to an inserted position as shown in FIG. 5. The slot 20 is approximately equal to the width of the cutting end of the clipper at the front wall, which fits closely against both sides of the jaws to prevent lateral movement of the clipper and to prevent escape of clippings within the body member. As the clipper is inserted, the head 56 of the clipper post slides up to inclined surface 23 onto the slot bottom 22, and then snaps into the depression 25. The depression 25 prevents the clipper from inadvertently slipping back out of the handle and clipping receptacle 10.

The slot 20 narrows near its rear end to allow the flanges 27 and 28 to bear against the rear end of the clipper jaws, forcing them against the slot bottom 22. The rear end of the clipper fits matingly into the rear receptacle 31 to prevent lateral movement thereof, as shown in FIGS. 3 and 5. The opening 59 in the clipper aligns with the bore 32 through the body member 12, allowing a thong or string to be threaded through the assembly, if desired.

The lever actuator 58 passes upwardly through the opening in the top surface 14 defined by the slot 20, and can be freely operated in the conventional manner. Clippings sheared from a nail will be thrown rearwardly into one of the inner cavities 29 or 30. The size and shape of the handle and clipping receptacle 10 as shown in the drawing relative to the clipper make the clipper easier to manipulate than the clipper alone.

When the inner cavities 29 and 30 are full of clippings or it is desired to remove the clipper from the handle and clipping receptacle 10 for any reason, the operator need merely grasp the lever 58 and pull upwardly and outwardly on the clipper. This action will disengage the head 56 from the depression 25 and allow the clipper to slide out of the slot 20. Reversing and shaking the body member 12 will easily discharge the accumulated clippings within the inner cavities.

It will thus be appreciated that the present invention provides a novel and improved nail clipper accessory that is removably engageable with a nail clipper, provides a convenient handle for manipulation of the clipper, and retains clippings cut by the clipper for subsequent convenient disposal.

While this invention has been described in detail with particular reference to a preferred embodiment thereof, it will be understood that variations and modifications can be made without departing from the spirit and scope of the invention as defined in the appended claims.

I claim:

1. A nail clippr handle for receiving a nail clipper of the type including a pair of elongated spring jaws fixed together at one end thereof and spaced apart at the opposite cutting end thereof, and a lever actuator attached to the upper end of a post extending through both said spring jaws adjacent to the cutting end thereof, said post including a head at the lower end of said post, said handle comprising:

a body member including a top exterior surface and a front exterior surface;

said body member comprising means defining a slot therein open to said front exterior surface for removably receiving said clipper;

means defining an opening in said top surface through which extends said lever actuator;

a depression formed in the bottom of said slot adjacent to said front exterior surface for receiving said head of said post;

said body member further defining at least one internal cavity behind said front surface and extending laterally from said slot in lateral communicating relation with said slot at a location where said jaws are spaced apart, so that the nail cuttings from said clipper are received and retained in said internal cavity laterally of the clipper; and said front surface defining said slot includes means fitting closely against the sides of both said jaws to prevent lateral movement of the jaws in the front surface notwithstanding said internal cavity in the body member.

2. A nail clipper handle for receiving a nail clipper of the type including a pair of elongated spring jaws fixed together at one end thereof and spaced apart at the opposite cutting end thereof, and a lever actuator attached to the upper end of a post extending through both said spring jaws adjacent to the cutting end thereof, said post including a head at the lower end of said post, said handle comprising:

a body member formed of resilient material including a top exterior surface and a front exterior surface;

said body member comprising a slot therein open to said front exterior surface for removably receiving said clipper, an opening in said top surface through which extends said lever actuator, and means for resiliently retaining said clipper within said slot; and said body member further comprising means defining at least one internal cavity located behind said front surface and extending laterally from said slot communicating with said slot at a location where said jaws are spaced apart, whereby the clippings from the nail clipper are caught and retained in said cavity in lateral spaced relation to the clipper.

3. The apparatus of claim 2, wherein said slot comprises a channel open to said top surface, and further comprising a flange extending over a portion of said clipper spaced rearwardly from said cutting end.

4. A nail clipper handle and clipping catcher for receiving a nail clipper of the type including a pair of elongated spring jaws fixed together at one end thereof and spaced apart at the opposite cutting end thereof, and a lever actuator attached to the upper end of a post extending through both said spring jaws adjacent to the cutting end thereof, said post including a head at the lower end of said post, said handle comprising:

a body member including a top exterior surface and a front exterior surface;

said body member including a slot therein open to said front exterior surface for removably receiving said clipper, an opening in said top surface through which extends said lever actuator, a depression formed in the bottom of said slot adjacent to said front exterior surface for receiving said head of said post, and at least one internal cavity extending laterally from said slot communicating with said slot at a location at which said jaws are spaced apart, whereby nail clippings from the clipper are caught in said internal cavity;

said slot comprising a channel open to said top surface, and further comprising a flange extending over a portion of said clipper spaced rearwardly from said cutting end;

said body member defining a cavity at the rear end of said channel for matingly receiving the attached ends of said jaws;

said jaws attached by a rivet having a central opening therethrough; and said body member defining a pair of openings communicating with said rivet opening so as to provide an opening passing through said body member and clipper.

5. A nail clipper handle and clipping catcher for receiving a nail clipper of the type including a pair of elongated spring jaws fixed together at one end thereof and spaced apart at the opposite cutting end thereof, and a lever actuator attached to the upper end of a post extending through both said spring jaws adjacent to the cutting end thereof, said post including a head at the lower end of said post, said handle comprising:

a body member including a top exterior surface and a front exterior surface;

said body member including a slot therein open to said front exterior surface for removably receiving said clipper, an opening in said top surface through which extends said lever actuator, a depression formed in the bottom of said slot adjacent to said front exterior surface for receiving said head of said post, and at least one internal cavity extending laterally from said slot communicating with said slot at a location at which said jaws are spaced apart, whereby nail clippings from the clipper are caught in said internal cavity; and said front surface defining said slot fitting closely against the sides of both said jaws to prevent lateral movement thereof.

6. A nail clipper handle for receiving a nail clipper of the type including a pair of elongated spring jaws fixed together at one end thereof and spaced apart at the opposite cutting end thereof, and a lever actuator attached to the upper end of a post extending through both said spring jaws adjacent to the cutting end thereof, said post including a head at the lower end of said post, said handle comprising:

a body member formed of resilient material including a top exterior surface and a front exterior surface;

said body member comprising a slot therein open to said front exterior surface for removably receiving said clipper, an opening in said top surface through which extends said lever actuator, and means for resiliently retaining said clipper within said slot;

said upper surface of said body member bearing upon said clipper;

said retaining means comprising a depression formed in the bottom of said slot for receiving said head of said post; and said body member further defining at least one internal cavity extending laterally from said slot and communicating with said slot at a location at which said jaws are spaced apart, whereby clippings from the nail clippers are caught and retained in said cavity.

7. The apparatus of claim 6, wherein said body member defines a cavity at the rear end of said channel for matingly receiving the attached ends of said jaws.

8. The apparatus of claim 7, wherein said front surface defining said slot fits closely against the sides of both said jaws to prevent lateral movement thereof.

* * * * *